United States Patent [19]

Albert

[11] 4,166,704

[45] Sep. 4, 1979

[54] ROTATING FLUID JET AGITATOR

[75] Inventor: Robert E. Albert, Wilmington, Del.

[73] Assignee: E. I. Du Pont de Nemours and Company, Wilmington, Del.

[21] Appl. No.: 891,407

[22] Filed: Mar. 29, 1978

[51] Int. Cl.[2] ..... B01F 5/20

[52] U.S. Cl. ..... 366/167; 366/262; 366/342

[58] Field of Search ..... 366/262, 168, 169, 174, 366/244, 245, 247, 263, 280, 281, 342, 167

[56] References Cited

U.S. PATENT DOCUMENTS

Re. 16,314 4/1926 Kenney ..... 366/169

2,143,652 1/1939 Gaertner ..... 366/262

*Primary Examiner*—George F. Mautz

[57] ABSTRACT

A rotating fluid jet agitator for mixing, dispersing, dissolving and suspending powders in liquids comprising at least one primary jet mixing nozzle arranged to rotate about a generally vertical axis submerged at a predetermined elevation in a tank to project a stream of liquid radially outward from said vertical axis. The agitator includes a drive nozzle arranged to deliver a generally horizontal component of thrust which causes the agitator to rotate about the vertical axis, a speed control means and a pump for circulating liquid from the tank to the mixing nozzle and drive nozzle.

4 Claims, 3 Drawing Figures

ROTATING FLUID JET AGITATOR

BACKGROUND OF THE INVENTION

This invention relates to liquid mixing equipment and, more particularly, to a rotating fluid jet agitator which is effective in mixing, dispersing, dissolving and suspending powders in liquids, and which is particularly useful for wettable powder and other dry formulations of agricultural chemicals in sprayable mixtures.

In the application of agricultural chemicals, such as herbicides, fungicides, insecticides and the like, to commercial crops, a common practice is to disperse solid pesticidal formulations into water, and then to spray the aqueous dispersion or solution over plants, soil, etc. to achieve uniform distribution of the active ingredient(s) on the target. There is a need for improving the methods and equipment used to insure uniform coverage at the desired rate rapidly, efficiently, and with minimum waste and equipment pluggage. Normally, several pesticides are combined into one sprayable mixture for convenience. With the development of new wettable powder and granular formulations and water soluble packages, and with a continuing trend towards more concentrated slurries and mixtures, many kinds of conventional mixing equipment, particularly the stationary fluid jet type, are no longer adequate for preparing sprayable mixtures, particularly when the pesticides are added to the aqueous mixture rapidly and in bulk.

It has been found that effective mixing can be accomplished without major changes to conventional spray mix tanks, pumps, piping and field procedures in accordance with this invention which is particularly pointed out in the appended claims and is illustrated in a preferred embodiment in the accompanying drawings wherein:

Figure 1:
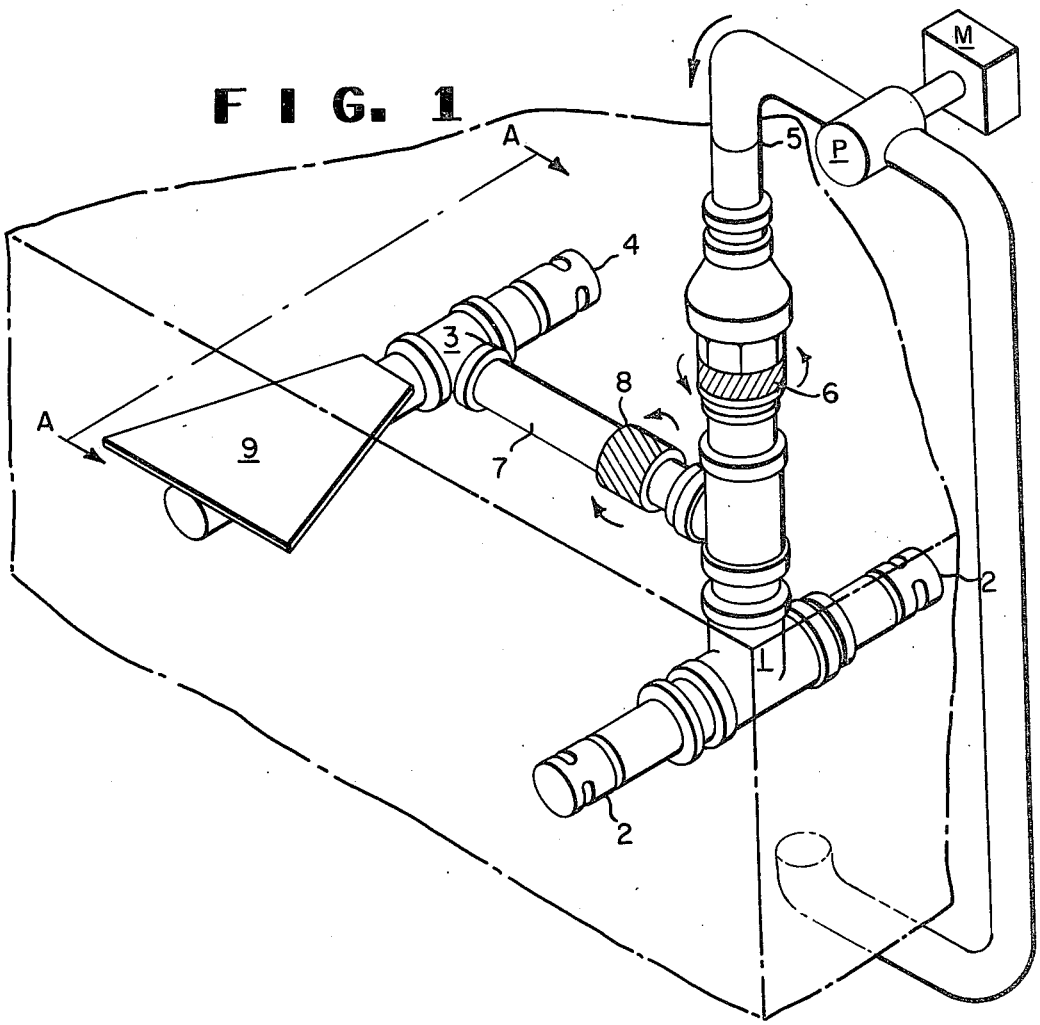
FIG. 1 is a perspective view of a rotating fluid jet agitator having a top inlet.
Figure 3:
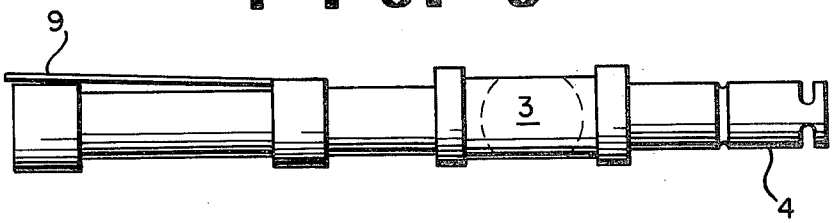
FIG. 3 is an elevational view of a typical drive nozzle and drag plate taken along line A—A of FIG. 1.
Figure 2:
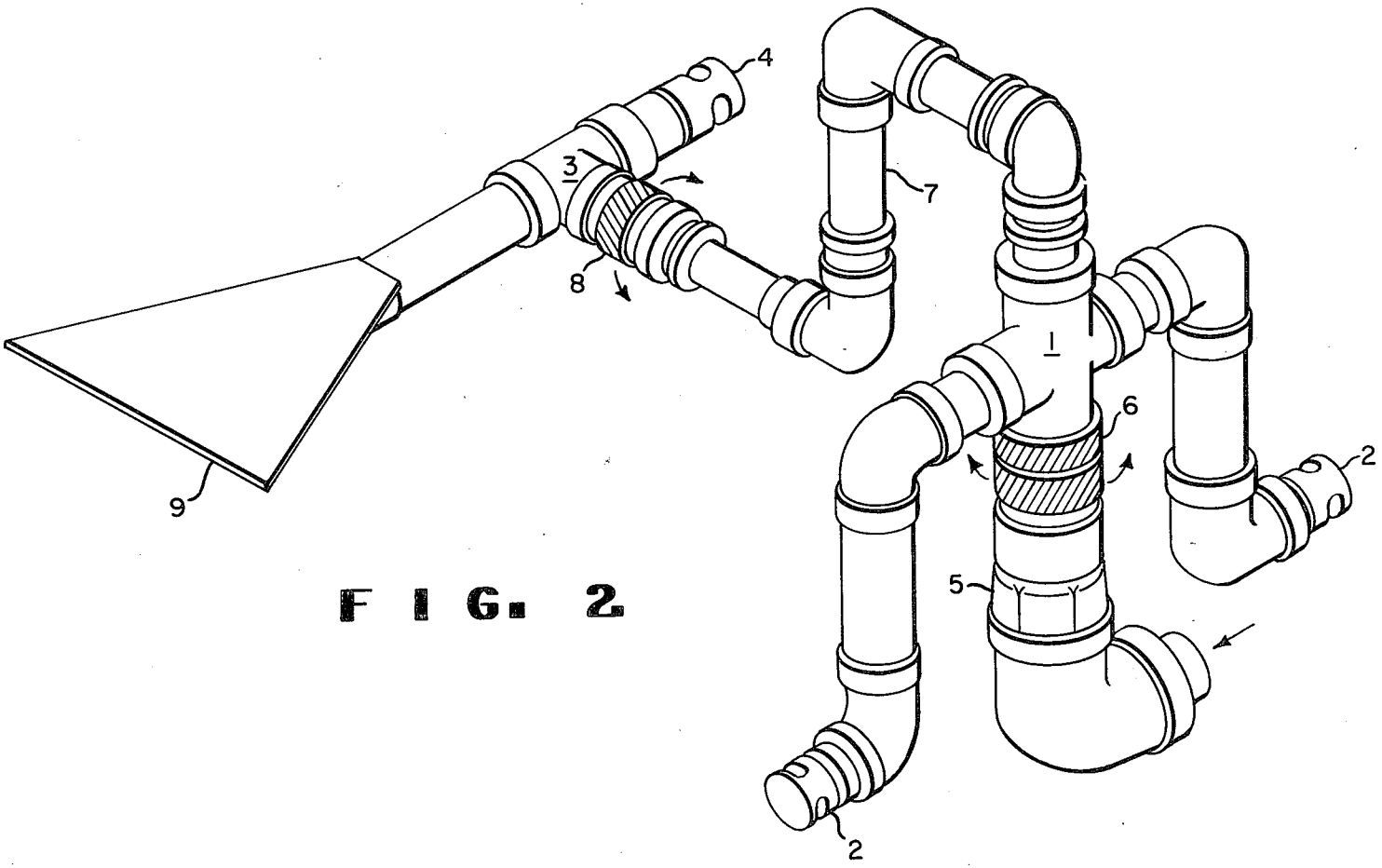
FIG. 2 is a perspective view of a rotating jet agitator having a bottom inlet.

Referring now to FIGS. 1 and 2, the present invention is comprised of two parts: (1) an agitator portion 1 having one or more primary jet mixing nozzle(s) 2, i.e., fluid jets, and (2) a drive portion 3 having at least one drive nozzle 4. The agitator, portion 1 is attached to a fluid inlet line 5 through a first swivel joint 6 which will permit 360° rotation. In this example, the agitator portion 1 and drive portion 3 are free to rotate about the generally vertical axis of the first swivel joint 6. The primary jet mixing nozzle(s) 2 should be arranged so that their net thrust should create zero torque around swivel joint 6. Preferably the center of the jet streams issuing from mixing nozzle(s) 2 should lie in a vertical plane containing the axis of rotation of swivel joint 6. The primary jet mixing nozzle(s) 2, which may or may not include a siphon cap, may be constructed of nylon, stainless steel or any other suitable material generally resistant to corrosion.

In a preferred embodiment of the instant invention the two primary spray nozzle(s) 2 are arranged to discharge 180° opposite one another at an elevation of about 3 in. (7 cm) to 5 in. (13 cm) above the bottom of a pesticide spray tank. Spray tanks normally employed may have either a curved or a flat bottom and include a recirculation system with a suitable pump p. For tanks having capacities in the range of about 50 to 1000 gallons (196 to 3800 liters) a centrifugal or roller type pump capable of producing a pressure in the range of about 10–50 pounds/square inch (0.70–3.52 kg/sq. cm) and a flow rate of about 14–90 gallons/minute (53 to 340 l/min) is preferred. Drive means m for the pump may be either an electric motor or gasoline/diesel engine. The pump inlet, i.e., suction side, communicates with the spray tank through any suitable arrangement of piping while the pump discharge is arranged to supply a volume of the liquid pesticide mixture to the agitator 1 through inlet line 5.

Rotation of the agitator is accomplished with the drive portion 3 which comprises at least one drive nozzle 4 and means for controlling or regulating the rotational speed of the agitator. The drive nozzle 4 is arranged to receive liquid under pressure from inlet line 5 through supply line 7 and produce a component of thrust which is capable of rotating agitator 1 about swivel joint 6. Supply line 7 forms a generally horizontal axis which extends radially outward from and perpendicular to the generally vertical axis of agitator rotation and becomes the moment arm which determines the torque resulting from the thrust of the drive nozzle 4. The agitation, i.e., mixing of the pesticide solution in the tank, is most effective and uniform when the agitator 1 is rotated at a speed of about 0.5 to 15 rev/min., preferably from about 2 to 10 rev/min. The concentrated stream produced by the primary jet mixing nozzle(s) 2 can then sweep the entire bottom of the liquid spray tank uniformly.

Control of the agitator rotational speed can be accomplished by providing a second swivel joint 8 in supply line 7 so that drive nozzle 4 may rotate independently thereabout. In a preferred embodiment the rotation of nozzle 4 about swivel joint 8 is restricted to an arc which is less than 90° from a horizontal plane by providing suitable stops to control the rotation of nozzle 4 from about 1° above the horizontal plane to about 89° above the horizontal plane. A vane or drag plate 9 of any desired configuration is attached to supply line 7 at a suitable location downstream of swivel joint 8. As the agitator 1 begins to rotate, fluid resistance against drag plate 9 increases thereby causing drive nozzle 4 to rotate about swivel joint 8. As this occurs the component of thrust rotating the agitator diminishes and agitator rotational speed diminishes. As fluid resistance against drag plate 9 decreases, drive nozzle 4 therefore moves to a more horizontal position and the rotational speed of the agitator can again increase.

The weight and position of drag plate 9 is critical to the instant invention. The center of gravity of the drag plate and drive nozzle assembly must be such that the assembly will be restored by the force of gravity to a nearly horizontal position when the rotational speed of the agitator is or approaches zero. The arrangement of drag plate 9 and drive nozzle 4 provides speed control and self-compensating variable thrust to insure that primary jet mixing nozzle(s) 2 uniformly and completely sweep the bottom of the tank. The size of orifice and the pressure of the liquid supplied to drive nozzle 4 determine the maximum thrust obtained for rotation. The position of the drag plate can be changed in order to change the rotational speed of the assembly. Use of the invention is relatively inexpensive and does not require extraordinary equipment or skills.

The following example provides a description of a specific embodiment and the operation of the instant invention.

EXAMPLE I

A fluid jet agitator is assembled as shown in FIG. 1. Inlet line 5 is a 1½ in. schedule 40 stainless steel pipe and swivel joint 6 is a Rainbird Bearing Assembly 100,580 (Rainbird, Glendora, Calif.). Primary jet mixing nozzle(s) 2 of agitator 1 are No. 12381-SC-25-NY jet agitators from Spraying Systems Co., Wheaton, Ill. and connect to swivel joint 6 with 1 in. schedule 40 stainless steel pipe and fittings. Drive portion 3 is comprised of ¼ in. schedule 40 stainless steel pipe and fittings and drive nozzle 4, which is a No. 6290-SC-10 jet agitator from Spraying Systems Co., is located 25 cm horizontally from the center line of swivel joint 6. Drag plate 9 is a 16 ga. stainless steel sheet which forms an isosceles triangle having a base of 7 in. (17.5 cm) and a height of 5 in. (12.7 cm). The plate is attached to the drive portion as shown in FIG. 1. Swivel joint 8 is a No. 100,121 Type Tee bearing assembly from Rainbird. A Hydro Model 9202 centrifugal pump from Lear Siegler, Inc., St. Paul, Minn. is employed to circulate water at a pressure of 45 lbs./in.$^2$ (3.16 kg/cm$^2$) to the agitator which is arranged at the center of a rectangular tank 48 in. (122 cm) long, 30 in. (76.2 cm) wide and 24 in. (61 cm) deep. The agitator is located 3 in. (7.6 cm) from the tank bottom and the tank is filled with 125 gallons (473 liters) of water at 5° C. At the above pressure the fluid jet agitator provided vigorous mixing without splashing and rotated at 8 rev/min.

To the agitated water in the tank was added simultaneously five 2 lb (909 g) packages of Lannate® methomyl insecticide (E. I. du Pont de Nemours & Co., Wil., De.) in soluble film packages. The packages and insecticide were completely dissolved in 3.5 minutes. Conventional stationary jet agitators required in excess of twenty minutes to dissolve the five packages and insecticide, and some lumps of insecticide remained at the tank bottom in areas where agitation was minimal.

As many widely different embodiments of this invention can be made without departing from the spirit and scope thereof, it is to be understood that this invention is not limited to the specific embodiments thereof except as defined in the appended claims, and all changes which come within the meaning and range of equivalence are intended to be embraced therein.

What is claimed is:

1. A rotating fluid jet agitator for mixing liquids in tanks which comprises an agitator portion having at least one primary jet mixing nozzle arranged to rotate about a generally vertical axis at a predetermined elevation in said tank to project a stream of liquid radially outward from said vertical axis;

means for rotating said primary jet mixing nozzle about said vertical axis comprising a drive nozzle attached to said agitator portion and arranged to deliver a generally horizontal component of thrust to cause said agitator to rotate about said vertical axis;

means for circulating liquid under pressure to said primary jet mixing nozzle and said drive nozzle from said tank; and control means for controlling the speed at which said primary nozzle rotates about said vertical axis.

2. The fluid jet agitator of claim 1 in which said means for circulating liquid under pressure comprises a pump having an inlet communicating with said liquid in said tank and an outlet communicating with said primary jet mixing nozzle for pumping liquid under pressure from said tank to said primary nozzle and means for driving said pump.

3. The fluid jet agitator of claim 2 in which said control means comprises a drag plate mounted on said drive nozzle and extending in the direction of rotation, and a swivel joint located between said drive nozzle and said agitator portion to form a generally horizontal axis about which said drive nozzle and said drag plate are arranged to rotate to vary said horizontal component of thrust.

4. The fluid jet agitator as claimed in claim 1 in which said stream of liquid is projected radially outward from said vertical axis from about 15° below to about 15° above the plane of rotation.

* * * * *